US007219475B2

(12) United States Patent
Stollenwerk et al.

(10) Patent No.: US 7,219,475 B2
(45) Date of Patent: May 22, 2007

(54) METHOD AND APPARATUS FOR APPLYING A MODULAR PANELING ASSEMBLY

(75) Inventors: Paul B. Stollenwerk, Shorewood, WI (US); Todd M. Graf, Plymouth, WI (US); James R. Burkel, Port Washington, WI (US)

(73) Assignee: Allen-Edmonds Shoe Corporation, Port Washington, WI (US)

( * ) Notice: Subject to any disclaimer, the term of this patent is extended or adjusted under 35 U.S.C. 154(b) by 461 days.

(21) Appl. No.: 10/671,082

(22) Filed: Sep. 26, 2003

(65) Prior Publication Data

US 2005/0066608 A1 Mar. 31, 2005

(51) Int. Cl.
*E04B 2/00* (2006.01)
*E04B 1/38* (2006.01)
*E06B 3/26* (2006.01)

(52) U.S. Cl. ..... 52/506.05; 52/506.01; 52/510; 52/511; 52/202

(58) Field of Classification Search ..... 52/202, 52/506.01, 506.05, 506.06, 510, 511; 40/780, 40/777

See application file for complete search history.

(56) References Cited

U.S. PATENT DOCUMENTS

| | | | | |
|---|---|---|---|---|
| 3,745,704 | A * | 7/1973 | Covington | 49/57 |
| 4,685,261 | A * | 8/1987 | Seaquist | 52/202 |
| 5,347,775 | A * | 9/1994 | Santos | 52/202 |
| 5,426,893 | A * | 6/1995 | Hoffman | 49/464 |

* cited by examiner

*Primary Examiner*—Naoko Slack
*Assistant Examiner*—Elizabeth A. Plummer
(74) *Attorney, Agent, or Firm*—Andrus, Sceales, Starke & Sawall, LLP

(57) ABSTRACT

A modular paneling assembly and method of applying same is provided. The modular paneling assembly includes at least one elongated panel member, upper and lower rails defining upper and lower recesses, respectively, the upper and lower recesses spaced apart a distance greater than the distance between upper and lower edge portions of the panel member, such that the panel member is removably retained in the recesses when supported by the bottom rail. The method of applying the paneling assembly includes the steps of mounting the upper and lower rails to a mounting surface, inserting the upper edge portion of the panel member into the upper recess and inserting the lower edge portion of the panel member into the lower recess.

9 Claims, 3 Drawing Sheets

FIG. 2
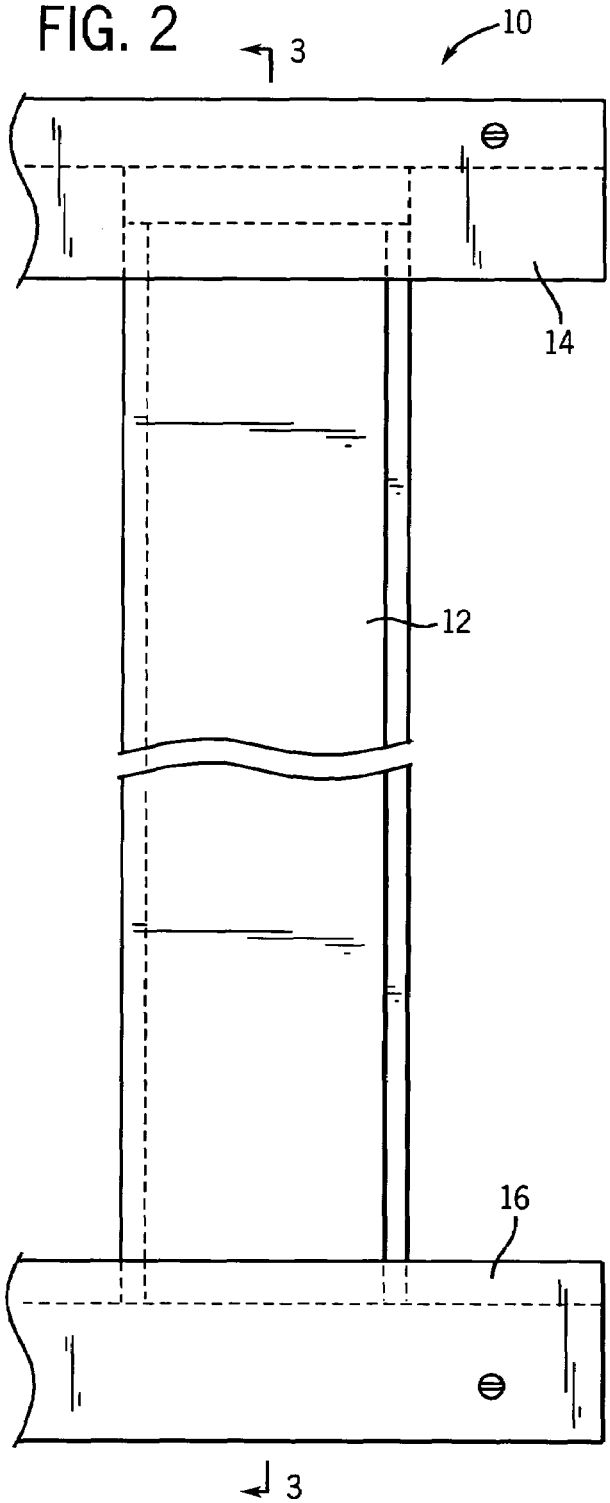
FIG. 3
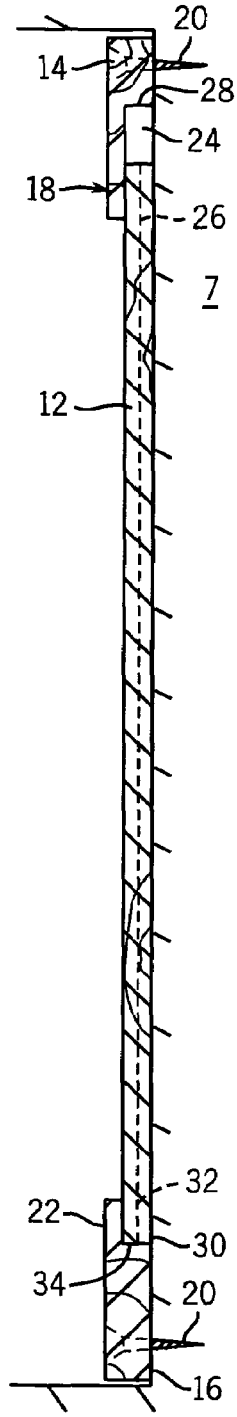
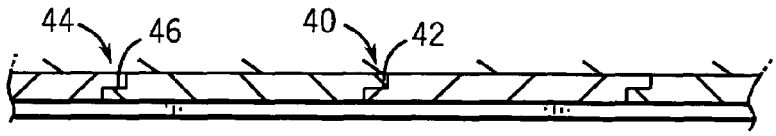
FIG. 5

METHOD AND APPARATUS FOR APPLYING A MODULAR PANELING ASSEMBLY

FIELD OF THE INVENTION

The present invention relates generally to a method and apparatus for applying a modular paneling assembly to a mounting surface. In the preferred embodiment, the present invention relates to a method and apparatus for applying aromatic cedar wood paneling to the walls of a confined area, such as a closet.

BACKGROUND OF THE INVENTION

There are many known advantages to using cedar wood to line the interior of a storage area for clothing, accessories, and other valuables. Cedar is a lightweight and dimensionally stable wood that lies flat and stays straight. Contrary to many other wood species, cedar resists the natural tendency to crack and check over time. In addition, most cedar wood is resistive to bacterial and fungal growth and contains natural oils that serve as preservatives to help the wood resist rot and decay. Naturally occurring organic compounds contained in cedar wood give off a richly distinct cedar aroma that smells good to humans, but makes the wood highly unattractive to insects, moths and other pests.

Although it is highly desirable to line the interior of a storage area with cedar wood, known methods for accomplishing this objective are typically complex and can be very expensive. Thus, unfortunately, many individuals that want to install a cedar closet liner are forced to pay expensive labor costs for professional installation by a carpenter or the like.

In addition, the beneficial aspects of cedar wood described above tend to degrade over time. As such, individuals looking to replace an old existing cedar closet liner are forced to pay expensive labor costs for removal and reinstallation by a professional, such as a carpenter or the like.

It is therefore desirable to provide a method and apparatus for applying a modular paneling assembly that is simple and low cost. It is desirable to provide such a method and apparatus which may be installed using little technical skill or know-how relating to carpentry or the like. It is desirable to provide a modular paneling assembly that may be easily installed in small areas and corners. It is also desirable to provide a modular paneling assembly that facilitates simple removal and replacement of individual panel members which are older or damaged.

SUMMARY OF THE INVENTION

The present invention is directed to a modular paneling assembly, such as cedar wood paneling, which can be easily mounted to a mounting surface. The invention provides a simple and low cost method for applying paneling to the walls of a confined area, such as a closet. The unique construction allows for panel members to be installed vertically, accommodating installation in small areas and corners. Existing panel members which may be older or damaged, are easily removed and replaced with new panel members.

The modular paneling assembly comprises at least one elongated panel member having an upper edge portion and a lower edge portion; a lower rail defining a lower recess for receiving and supporting the lower edge portion of the panel member; an upper rail defining an upper recess for receiving the upper edge portion of the panel member, the upper recess being deeper than the lower recess; the upper and lower recesses spaced apart a distance greater than the distance between the upper and lower edge portions such that the panel member is removably retained in the recesses when supported by the bottom rail.

In the preferred embodiment, the upper rail is mounted to a mounting surface and has a downwardly extending lip, wherein the lip and the mounting surface form the upper recess. The lower rail is mounted to the mounting surface and has an upwardly extending lip and a base surface, wherein the upwardly extending lip, the base surface and the mounting surface form the lower recess.

A further aspect of the preferred embodiment is that the panel member, upper rail and lower rail are formed of cedar wood. The panel member has at least one longitudinal side having a lip for mating with an adjacent panel member which also has a longitudinal side and a lip.

The method of applying a paneling assembly to a mounting surface comprises the steps of providing an elongated panel member having an upper edge portion and a lower edge portion; providing a lower rail defining a lower recess for receiving and supporting the lower edge portion of the panel member; providing an upper rail defining an upper recess for receiving the upper edge portion of the panel member, the upper recess being deeper than the lower recess; and mounting the upper rail and lower rail on a mounting surface, the upper and lower recesses spaced apart a distance greater than the distance between the upper and lower edge portions such that the panel member may be removably retained in the recesses when supported by the bottom rail.

Once the upper and lower rail are mounted on the mounting surface, the upper edge portion of the panel member is inserted into the upper recess and the lower edge portion of the panel member is inserted into the lower recess.

BRIEF DESCRIPTION OF THE DRAWINGS

FIG. 2 is a front view of the modular paneling assembly having a single elongated panel member.

FIG. 3 is a sectional view of the modular paneling assembly as taken along section 3—3 in FIG. 2.

FIG. 5 is a sectional view of the modular paneling assembly as taken along section 5—5 in FIG. 4.

DETAILED DESCRIPTION OF THE PREFERRED EMBODIMENT

In the preferred embodiment of the invention as described below, a modular paneling assembly and a method for mounting same to a mounting surface is provided.

Figure 1:
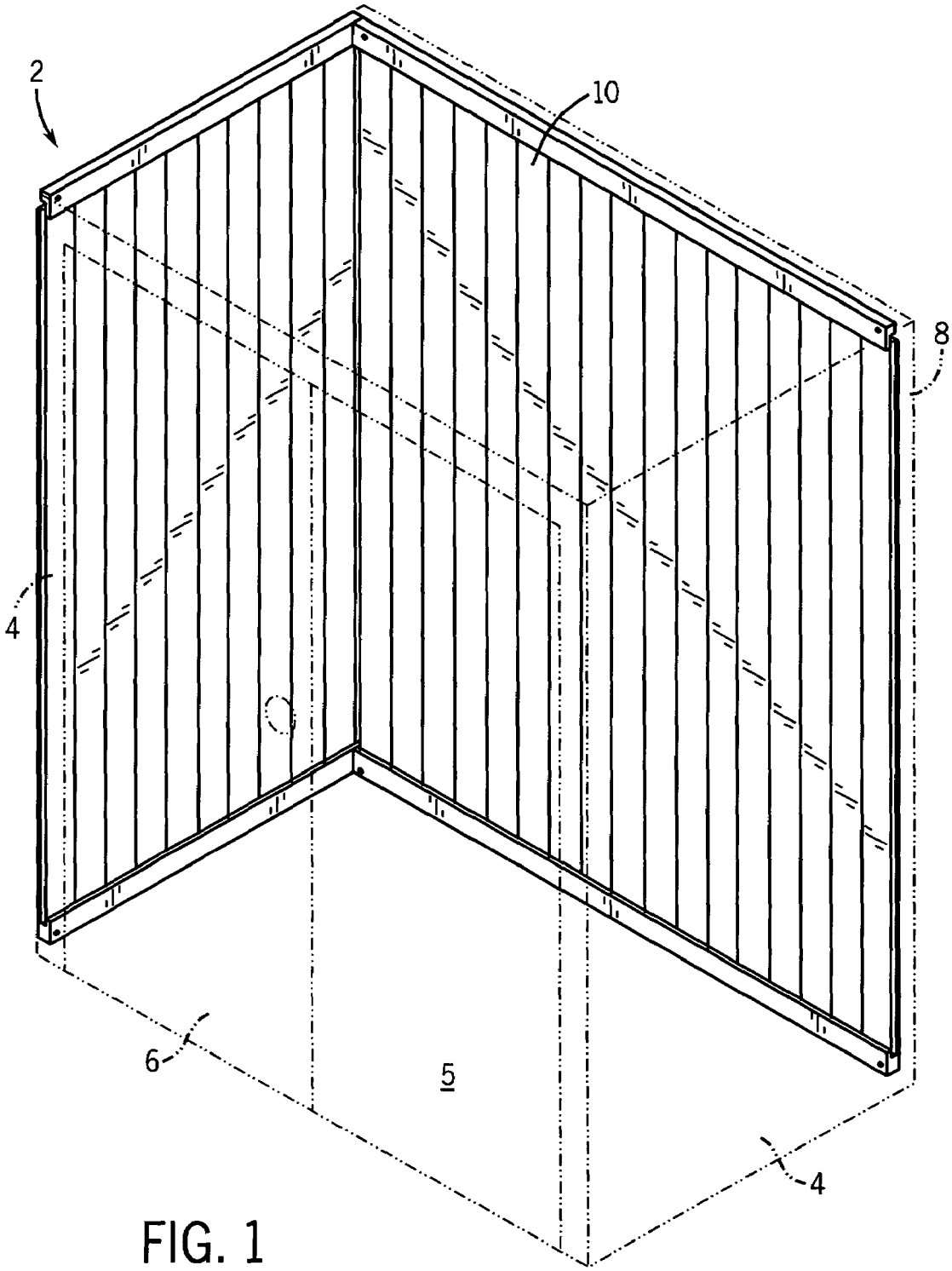
FIG. 1 is a perspective view of the modular paneling assembly applied to the side wall and rear wall of a storage closet.

As shown in FIG. 1, a storage area, or closet 2 has side walls 4, a front entry 6, and a rear wall 8. The modular paneling assembly 10 is mounted to mounting surfaces, or the side wall 4 and rear wall 8 of the closet 2. It is recognized that the modular paneling assembly may also be mounted to the remaining side wall 4 and front entry 6. If desired, the modular paneling assembly 10 may also be mounted to the floor 5 and ceiling 9 of the closet 2.

Referring to FIG. 2, the modular paneling assembly 10 includes at least one elongated panel member 12 disposed between upper rail 14 and lower rail 16. The panel member 12, while depicted as a rectangular member, may comprise a variety of shapes and sizes, such as for example, a square or S-shaped member. The panel member 12 may also comprise a variety of lengths and widths.

As shown in FIG. 3, upper rail 14 has a downwardly extending lip 18 and is mounted to a mounting surface, shown generally as 7, of the closet 2 by at least one fastener 20. The fastener 20 shown in FIG. 3 is a screw, however it should be recognized that any known means for fastening the upper rail 14 to the rear wall 8 will suffice, for example a nail, glue or the like.

The lower rail 16 has an upwardly extending lip 22 and is mounted to the mounting surface 7 by at least one fastener 20. As stated above, the fastener 20 may comprise a any known means for mounting a rail to a mounting surface.

As shown in FIG. 3, the upper rail 14 defines an upper recess 24, sized to receive an upper edge portion 26 of the panel member 12. More specifically, the upper recess 24 is defined by the downwardly extending lip 18, top 28, and mounting surface 7.

As further shown in FIG. 3, the lower rail 16 defines a lower recess 30 for receiving and supporting a lower edge portion 32 of the panel member 12. More specifically, the lower recess 30 is defined by upwardly extending lip 22, base 34 and the mounting surface 7 of closet 2.

The upper rail 14 and lower rail 16 are mounted to the mounting surface 7 and spaced apart a distance greater than the distance between the upper edge portion 26 and lower edge portion 32 of the panel member 12. More specifically, the top 28 and base 34 are spaced apart a distance greater than the distance between the upper edge portion 26 and lower edge portion 32 of the panel member 12.

Figure 6:
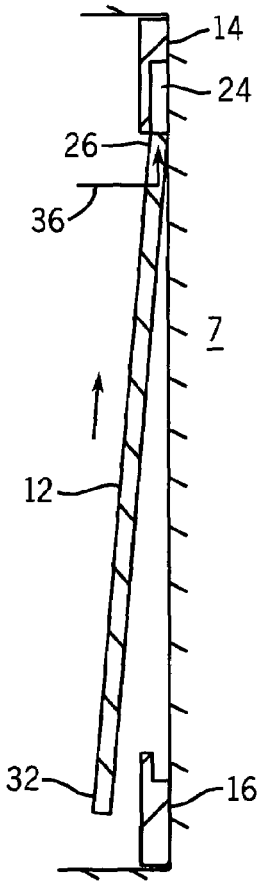
FIG. 6 is a side view of the modular paneling assembly having a panel member removed therefrom.
Figure 7:
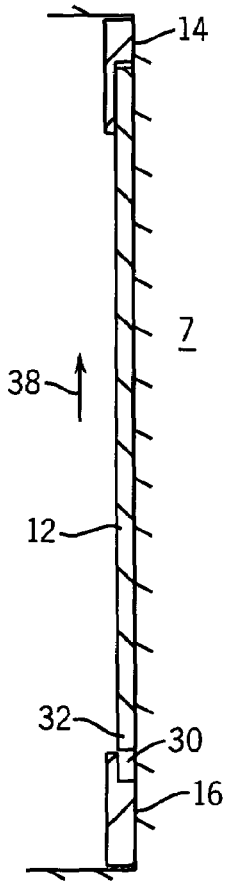
FIG. 7 is a side view of the modular paneling assembly showing the upper edge portion of the panel member inserted into the upper recess.
Figure 8:
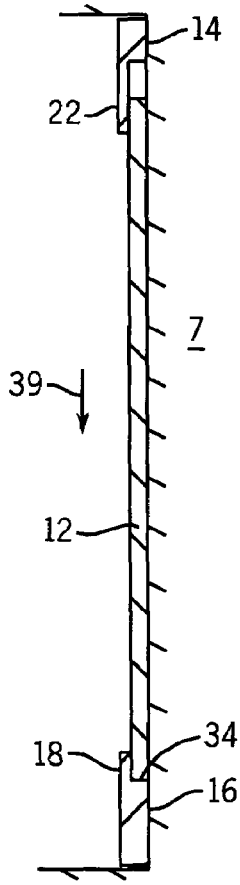
FIG. 8 is a side view of the modular paneling assembly wherein a lower edge portion of the panel member is inserted into the lower recess.

The unique paneling assembly permits the panel members to be installed vertically, accommodating quick easy installation in small areas and corners. Referring now to FIGS. 6–8, the panel member 12 is vertically installed between the upper and lower rails 14, 16. Once the upper rail 14 and lower rail 16 are mounted to the mounting surface 7, the upper edge portion 26 of the panel member 12 is wedged into the upper recess 24, as shown at arrows 36 and 38 in FIGS. 6 and 7. Once the upper edge portion 26 of the panel member 12 is inserted into the upper recess 24, and the panel member 12 is aligned flush with the mounting surface 7, the lower edge portion 32 is inserted downward into the lower recess 30, as shown at arrow 39 shown in FIG. 8. Thus, the panel member 12 is supported by base 34 of lower rail 16 and retained against the mounting surface 7 by downwardly extending lip 18 and upwardly extending lip 22.

To remove the panel member 12 from the upper rail 14 and lower rail 16, the above process is completed in reverse. Specifically, the panel member 12 is moved up as shown at arrow 38 in FIG. 7, causing the lower edge portion 32 to emerge from the lower recess 30. Thereafter, the lower edge portion 32 of the panel member 12 is pulled away from the mounting surface 7 and the upper edge portion 26 is removed from the upper recess 24.

Figure 4:
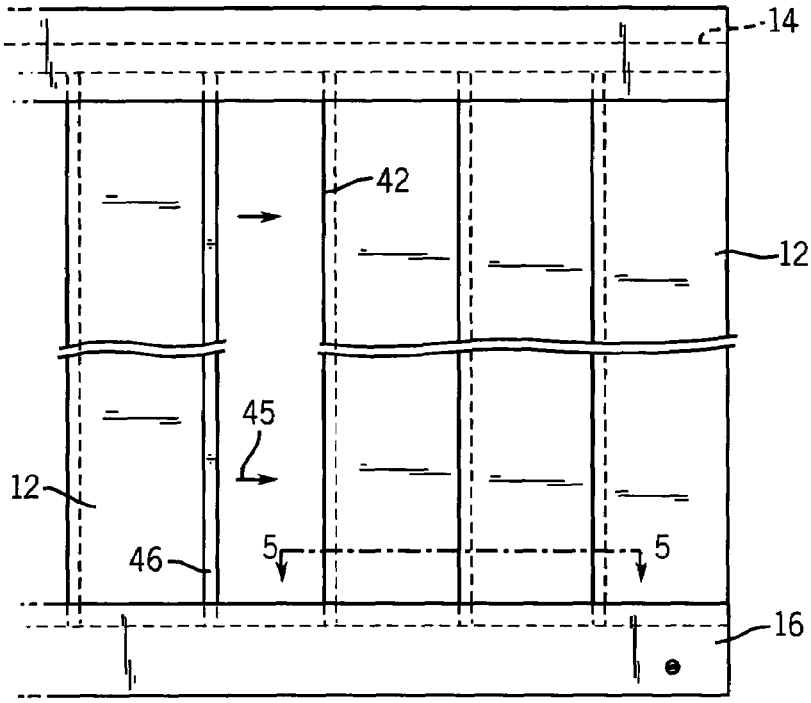
FIG. 4 is a front view of the modular paneling assembly having a plurality of panel members.

Referring now to FIG. 4, a series of panel members 12 are disposed between the upper rail 14 and the lower rail 16. As shown more clearly in FIG. 5, each panel member has a first longitudinal side 40 having an outer lip 42 and a second longitudinal side 44 having an inner lip 46. In this manner, adjacent panel members 12 mate with each other when positioned adjacent each other. More specifically, the panel members 12 are inserted into the upper recess 24 and lower recess 30 and subsequently slid into an adjacent position with an adjacent panel member, as shown by arrow 45 on FIG. 4. The inner lip 46 of one of the panel members mates with the outer lip 42 of the adjacent panel member. In this manner, a series of adjacent panel members vertically align to cover the mounting surface 7.

In the preferred embodiment, the longitudinal edges of the panel member 12 are chamfered, to create a more decorative appeal to the paneling assembly 10.

It is recognized that other equivalents, alternatives, and modifications aside from those expressly stated, are possible and within the scope of the appended claims. For example, while the method and apparatus of the present invention have been described in terms of a cedar paneling system for a storage area or closet, it is appreciated that the paneling system may comprise a variety of materials and may be installed in a variety of indoor and outdoor locations. It is also appreciated that outer and inner lips of the panel members may be replaced with an alternate mating structure, such as a tongue and groove arrangement.

We claim:

1. A modular paneling assembly for attachment to a mounting surface, said assembly comprising:

at least one elongated panel member having an upper edge portion and a lower edge portion;

a lower rail formed of cedar wood defining a lower recess for receiving and supporting said lower edge portion of said panel member;

an upper rail defining an upper recess for receiving said upper edge portion of said panel member, said upper recess being deeper than said lower recess;

said upper and lower recesses spaced apart a distance greater than the distance between said upper and lower edge portions such that the panel member is removably retained in said recesses when supported by said bottom rail.

2. The modular paneling assembly of claim 1 wherein said lower and upper rails are mounted to the mounting surface.

3. The modular paneling assembly of claim 2 wherein said upper rail further comprises a downwardly extending lip, wherein said lip and the mounting surface form said upper recess.

4. The modular paneling assembly of claim 2 wherein said lower rail further comprises an upwardly extending lip and a base surface, wherein said upwardly extending lip, said base surface and said mounting surface form said lower recess.

5. The modular paneling construction of claim 2 further comprising at least one fastener for coupling at least one of said top rail and said bottom rail to said mounting surface.

6. The modular paneling assembly of claim 1 wherein said panel member further comprises at least one longitudinal side having a lip for mating with an adjacent panel member.

7. The modular paneling assembly of claim 6 wherein said panel member comprises at least one chamfered edge.

8. The modular paneling assembly of claim 1 wherein said at least one panel member is formed of cedar wood.

9. The modular paneling assembly of claim 1 wherein said upper rail is formed of cedar wood.

* * * * *